US005133267A

United States Patent [19]

Kent et al.

[11] Patent Number: 5,133,267

[45] Date of Patent: Jul. 28, 1992

[54] METHOD AND APPARATUS FOR USING HAZARDOUS WASTE TO FORM NON-HAZARDOUS AGGREGATE

[75] Inventors: John M. Kent, Slidell; Henry L. Robards, Jr., Thibodaux, both of La.

[73] Assignee: Marine Shale Processors, Inc., St. Rose, La.

[21] Appl. No.: 769,260

[22] Filed: Oct. 1, 1991

[51] Int. Cl.[5] ..... F23G 5/00; F23G 5/12

[52] U.S. Cl. ..... 110/346; 110/211; 110/212; 110/214; 110/215; 110/235; 110/246; 110/259

[58] Field of Search ..... 110/346, 165 A, 239, 110/259, 211, 212, 214, 215, 213; 432/113

[56] References Cited

U.S. PATENT DOCUMENTS

| | | | |
|---|---|---|---|
| 3,592,151 | 7/1971 | Webber . | |
| 3,618,537 | 11/1971 | Bogue . | |
| 3,697,256 | 10/1972 | Engle . | |
| 3,766,866 | 10/1973 | Krumm . | |
| 3,848,548 | 11/1974 | Bolejack, Jr. et al. . | |
| 3,938,449 | 2/1976 | Frisz et al. . | |
| 4,007,027 | 2/1977 | Froberg . | |
| 4,063,903 | 12/1977 | Beningson et al. . | |
| 4,193,354 | 3/1980 | Woods . | |
| 4,270,470 | 6/1981 | Barnett et al. . | |
| 4,290,797 | 9/1981 | Rossi . | |
| 4,308,809 | 1/1982 | Woods . | |
| 4,331,088 | 5/1982 | Gold . | |
| 4,361,100 | 11/1982 | Hinger . | |
| 4,398,475 | 8/1983 | McKiel, Jr. . | |
| 4,437,419 | 3/1984 | Hertel . | |
| 4,546,711 | 10/1985 | Kerwin . | |
| 4,574,714 | 3/1986 | Bach et al. . | |
| 4,598,650 | 7/1986 | Schneckenberger . | |
| 4,602,574 | 7/1986 | Bach et al. . | |
| 4,658,736 | 4/1987 | Walter . | |
| 4,667,608 | 5/1987 | Chang . | |
| 4,682,548 | 7/1987 | Peng . | |
| 4,695,447 | 9/1987 | Shultz . | |
| 4,784,604 | 11/1988 | O'Connor . | |
| 4,787,320 | 11/1988 | Raaness et al. . | |
| 4,794,871 | 1/1989 | Schmidt et al. . | |
| 4,862,813 | 9/1989 | Levin et al. . | |
| 4,889,058 | 12/1989 | Yang et al. . | |
| 4,922,841 | 5/1990 | Kent . | |
| 5,027,722 | 7/1991 | Schwyter | 110/259 |
| 5,052,312 | 10/1991 | Rackley et al. | 110/346 |

FOREIGN PATENT DOCUMENTS

| | | |
|---|---|---|
| 0277604 | 8/1988 | European Pat. Off. . |
| 0247894 | 9/1988 | European Pat. Off. . |
| 2235335 | 4/1975 | France . |
| 58-156109 | 9/1983 | Japan . |
| 2127945A | 4/1984 | United Kingdom . |

OTHER PUBLICATIONS

Ford Bacon & Davis/BKMI Thermal Waste Destruction Systems (no date).

C. E. Raymond Rotary Incinerator Systems, Solutions for Hazardous and Toxic Waste Disposal, pp. 1-8, 1987.

A. Eggen et al., Experience in Slagging Pyrolysis Systems Presented before the Incinerator Division Research Committee, pp. 257-269; Oct. 28, 1971.

W. R. Duffett, Hazardous Materials & Waste Management Magazine, pp. 15-17, (Nov.-Dec. 1987).

Von Roll Corporation Information, p. 1021.

Phillips Petroleum Company Hazardous Waste Incinerator, Brochure of May 1987, and News Release of Jun., 1987.

C-E Raymond Guide to Quality Equipment, pp. 109, 11-12.

*Primary Examiner*—Edward G. Favors

*Attorney, Agent, or Firm*—Finnegan, Henderson, Farabow, Garrett & Dunner

[57] ABSTRACT

Hazardous waste is formed into non-hazardous non-leaching aggregate by introducing particulate noncombustible material into at least one oxidizer beneath the surface of an accumulation of molten noncombustible material. It is preferred that the walls of a portion of the apparatus be comprised of a layer of refractory material containing metal pins over a metal-walled, water-cooled vessel.

23 Claims, 7 Drawing Sheets

METHOD AND APPARATUS FOR USING HAZARDOUS WASTE TO FORM NON-HAZARDOUS AGGREGATE

BACKGROUND OF THE INVENTION

The present invention relates to a method and apparatus for using hazardous waste to form non-hazardous aggregate by thermally induced oxidation.

Many industrial processes produce by-products and waste materials that cannot be legally disposed of without some type of containment or treatment. Efforts in the past to dispose of such materials within containment vessels have proved inadequate since lack of attention to the manufacture of such containment vessels or their deterioration results in leakage or spillage of the hazardous waste. Other means of treating hazardous waste include the injection of such materials into wells, however, such materials may not be immobile within the strata into which they are injected and may find their way into underground aquifers.

In addition to the technical problems associated with such disposal techniques, there remains potential liability for anyone using such facilities. Years after the materials are deposited at the disposal site, claims for liability can be generated based on the knowledge that a party has been responsible for placing hazardous material within an approved waste disposal site only to have the disposal site be unsuccessful in preventing dispersion of the waste. Such problems have generated a search for means of using hazardous waste in a manufacturing process to eliminate its hazardous nature to produce a product suitable for sale to and use by the general public. One of the means attempted has been to oxidize the material by passing it through various types of heaters under oxidizing conditions. One such variation of such a process uses a counter-current rotary kiln to induce combustion of the combustible components in the hazardous waste and to aggregate the noncombustible material into a form that could be sold as a commercially valuable and useful product.

Efforts using this particular method have been partially successful in manufacturing a product that will pass the applicable EPA regulations associated with the disposal of waste. These processes, however, have significant shortcomings.

Many of the shortcomings of these previous processes have been eliminated by the use of the apparatus and methods disclosed in U.S. Pat. Nos. 4,922,841 and 4,986,197 to John M. Kent. Those patents disclose apparatus and processes that eliminate the most significant shortcoming associated with the use of hazardous waste in a thermal process, namely the generation of additional noncombustible material that must be disposed of as hazardous waste. The present inventions are improvements of the processes and apparatus disclosed in those patents.

Therefore, it is one object of the present invention to provide an apparatus for using hazardous waste material as a recyclable material in a manufacturing process such that the only products of such an apparatus are non-hazardous and may be sold for use by the general public without concern as to the nature of the input materials that were processed.

It is another object of the invention to convert hazardous solid materials to a non-hazardous, inert aggregate that may be sold without restriction.

It is an additional object of the invention to convert hazardous solid materials to a non-hazardous, inert aggregate in a manner that reduces the amount of potentially hazardous material in the gases within the treatment system.

It is a further object of the invention to provide an apparatus that is not subject to frequent interruptions in its operation for required periodic maintenance or repair.

These and other objects of the invention will be more fully disclosed in the present specification or may be apparent from practice of the invention.

SUMMARY OF THE INVENTION

To achieve these and other objects of the invention, there is provided an apparatus for converting hazardous waste into a non-hazardous aggregate. The apparatus includes: a source of particulate solid materials, volatile gases and gaseous combustion by-products. The apparatus further includes oxidizing means comprised of at least one refractory-lined, water-cooled, metal-walled vessel. Further included are means for introducing the particulate solid material, volatile gases and gaseous combustion by-products to the oxidizing means. The apparatus further includes means for inducing combustion in the oxidizing means, the heat of combustion forming molten slag and noncombustible fines from the noncombustible material. Means are provided for accumulating the slag. Also included are means for introducing the noncombustible fines to the molten slag to form a substantially molten mixture, the said introducing means further include means for injecting portions of the noncombustible fines into the molten slag beneath the outer surface of the slag. Means are also provided for removing the molten mixture from the apparatus and cooling the molten mixture to form the non-hazardous, non-leaching aggregate.

Another preferred embodiment of the invention is a process for converting hazardous waste into non-hazardous, non-leaching aggregate where particulate solid materials are oxidized to form noncombustible fines. A portion of the noncombustible fines are melted to form a layer of molten material. Another portion of the noncombustible fines are added to the molten material beneath the layer of molten material to form an accumulation of noncombustible material and the surface of the accumulation is melted. Molten material is removed from the surface and cooled.

Preferably, the noncombustible fines are introduced to the accumulation in discrete portions. It is further preferred that the portions of noncombustible fines form a pile with heat being impinged on the surface of the pile.

BRIEF DESCRIPTION OF THE DRAWINGS

The drawings, which form a portion of the specification, depict embodiments of the invention.

DESCRIPTION OF THE PREFERRED EMBODIMENT

The present invention will be disclosed in reference to an apparatus for converting hazardous waste into non-hazardous aggregate and a process of operating such apparatus for carrying out that function. As the present invention is an improvement of the processes and apparatus of U.S. Pat. Nos. 4,922,841 and 4,986,197. Those patents are incorporated by reference into the present specification.

In accordance with the invention the apparatus includes a source of high temperature gases, vapors, particulate materials or mixtures thereof. As here embodied the source of such materials is the rotary kiln 10 depicted in FIG. 1. In this embodiment the rotary kiln 10 has an entry portion 12 and an exit portion 14. Located between the entry and exit portions of the rotary kiln, is the combustion portion 16.

Figure 1:
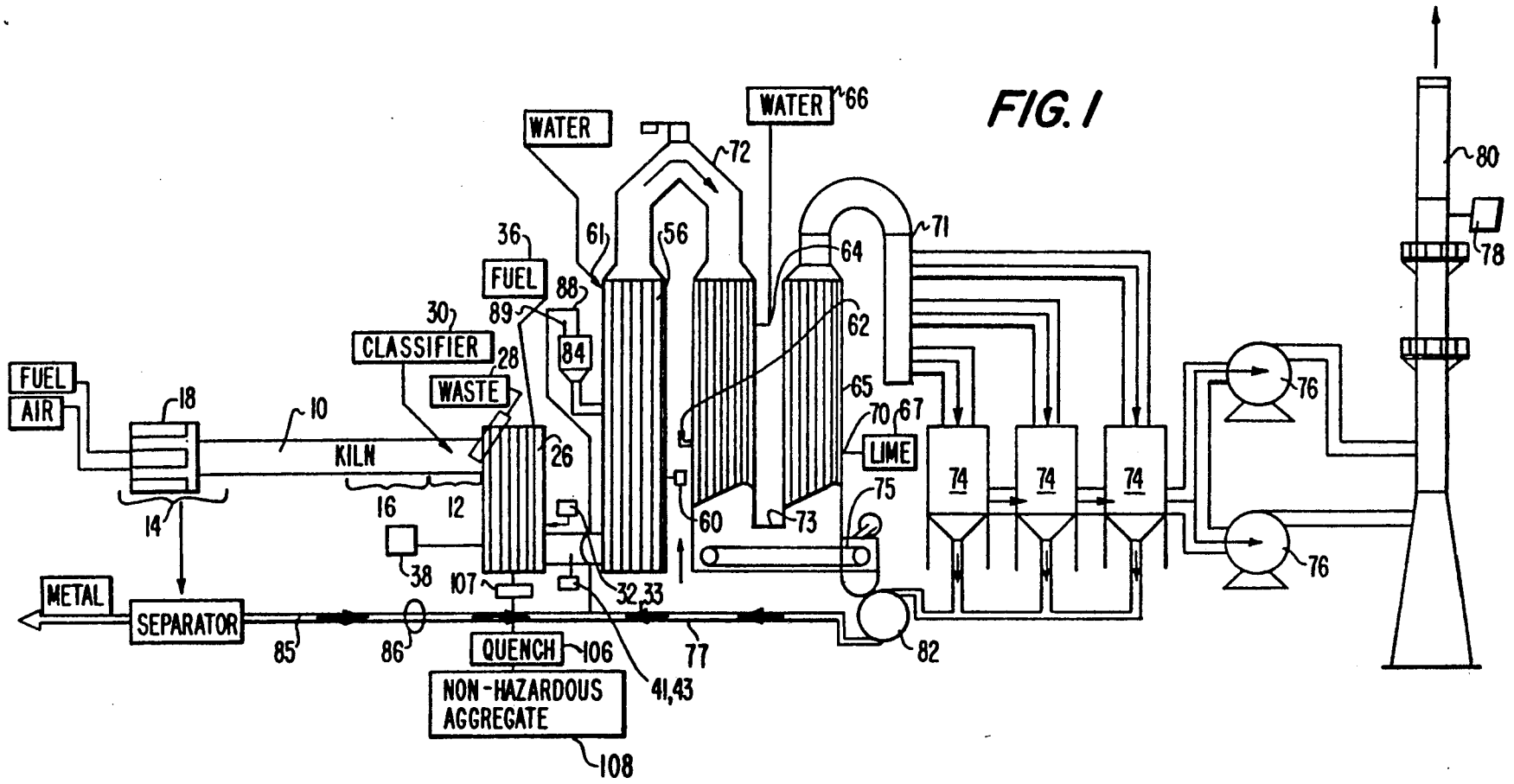
FIG. 1 is a schematic representation of a system including one embodiment of the present invention.

The kiln depicted schematically in FIG. 1 is a standard counter current rotary kiln constructed for the treatment of limestone or oyster shell to form lime. The rotary kiln is supported on conventional bearing supports (not shown) and driven at rotational speeds in the range of 1 to 75 RPH by conventional kiln drive means (not shown).

In this embodiment solids are introduced to the entry portion 12 of the rotary kiln 10 from a source of waste 28. The waste from source 28 may be supplemented by waste from classifier 30. As the kiln rotates, the material larger than about 50 microns travels through the combustion zone 16 toward the exit portion 14 while the smaller material is entrained in the gas flowing counter current to the larger solid material. In the embodiment depicted, the rotary kiln 10 includes cooling chambers 18 on the exit portion of the kiln. An air fuel mixture is introduced to the rotary kiln 10 at the exit portion 14 with gases in the kiln 10 passing toward the entry portion 12 counter-current to the larger solids being transported by rotation of the kiln toward the exit portion 14. The smaller particles are entrained in the gases passing through the kiln and are thus separated from the larger solids and transported from the kiln. Combustion in the kiln and the separation of larger from smaller particulate material thus provides a source of high temperature gases, vapors, particulate materials or mixtures thereof.

In accordance with the invention, the apparatus includes at least one hollow vessel having an interior in flow communication with the source of high temperature gases, vapors, particulate materials or mixtures thereof. As here embodied, the apparatus includes a first oxidizer 26. In accordance with the invention the vessel, here first oxidizer 26, has a wall construction comprising; a water-cooled metal wall, a refractory inner lining and a plurality of metal members passing through said refractory inner lining and contacting the metal wall. As here embodied and depicted in FIG. 3, first oxidizer 26 has a wall 46 comprised of outer shell 106, a water jacket 107 and an inner shell 110. A refractory inner lining 112, having a plurality of metal pins 114 passing therethrough, lines the inner surface 115 of the inner shell 110. In a preferred embodiment, the refractory consists essentially of alumina (90% alumina refractory, Westco TexCast T-QF Westco Refractory Corp. Dallas Tex.) and has a thickness in the range of from 2 to 3 inches. The pins are preferably ferrous-based metal such as low carbon steel, stainless steels such as types 304, 310 and 330 or other high temperature metal alloys such as Inconels. The pins preferably have diameters in the range of from 0.25 to 0.375 inch (6.3 to 10.2 millimeters) and are spaced one from the other depending on their location in the apparatus.

It is further preferred that the pins have a surface that will engage the surrounding refractory; and threaded straight studs welded to the vessel walls have proven to be effective. Such studs are readily attached to the vessel walls with conventional stud welding apparatus using electric arc welding. Coolant flows through a water jacket 107 to reduce the operating temperature of the refractory inner lining and the metal pins reduce the temperature gradient between the inner surface of the refractory and the outer surface of the inner shell.

One of the functions of the refractory lining is to reduce heat loss by conduction through the vessel walls but such heat loss is not entirely detrimental. Much of the fuel being consumed by the apparatus is hazardous material for which the owner of such apparatus is paid to use. Thus, if the apparatus is not thermally efficient, more fuel must be used; but that increases the revenue generated by operation of the apparatus.

As shown in FIG. 1, the first oxidizer 26 is adjacent to the entry portion 12 of the rotary kiln. Oxidizer 26 is in flow communication with the entry portion 12 of the rotary kiln 10 and receives volatile gas driven off the material introduced to the rotary kiln as well as the combustion by-products from the combustion taking place in the rotary kiln. A source of waste material introduces material to the entry portion 12 of the kiln 10, where the counter-current gas flow effects a separation of the larger particles and the smaller particles.

In accordance with the invention, there is provided means introducing the high temperature gases, vapors, particulate materials and mixtures thereof to the vessel, here oxidizer 26. As here embodied the apparatus includes fans 76 that induce a draft throughout the entire apparatus drawing the high temperature gases, vapors, particulate materials and mixtures thereof from the rotary kiln. The materials from the rotary kiln, the combustion by-products from the oxidizers and all the gases passing through the system pass through the fans 76 such that the apparatus runs at sub-atmospheric pressure.

In accordance with the invention the apparatus includes means for inducing combustion in the vessel to convert the high temperature gases, vapors, particulate materials and mixtures thereof to noncombustible fines, molten slag and waste gas.

As here embodied, the means for inducing combustion in the oxidizer 26 comprise an oxidizer fuel source 36 and an oxygen source 38. Thus, the oxidizer 26 receives particulate material from the rotary kiln 10 which, may or may not be combustible. In the present embodiment, first oxidizer 26 operates at a temperature in the range of from 1800° F. to 3000° F. In an oxidizing environment, combustible materials within the first oxidizer 26 are converted to waste gas and noncombustible fines. The noncombustible fines may or may not be melted depending on their composition.

Figure 2:
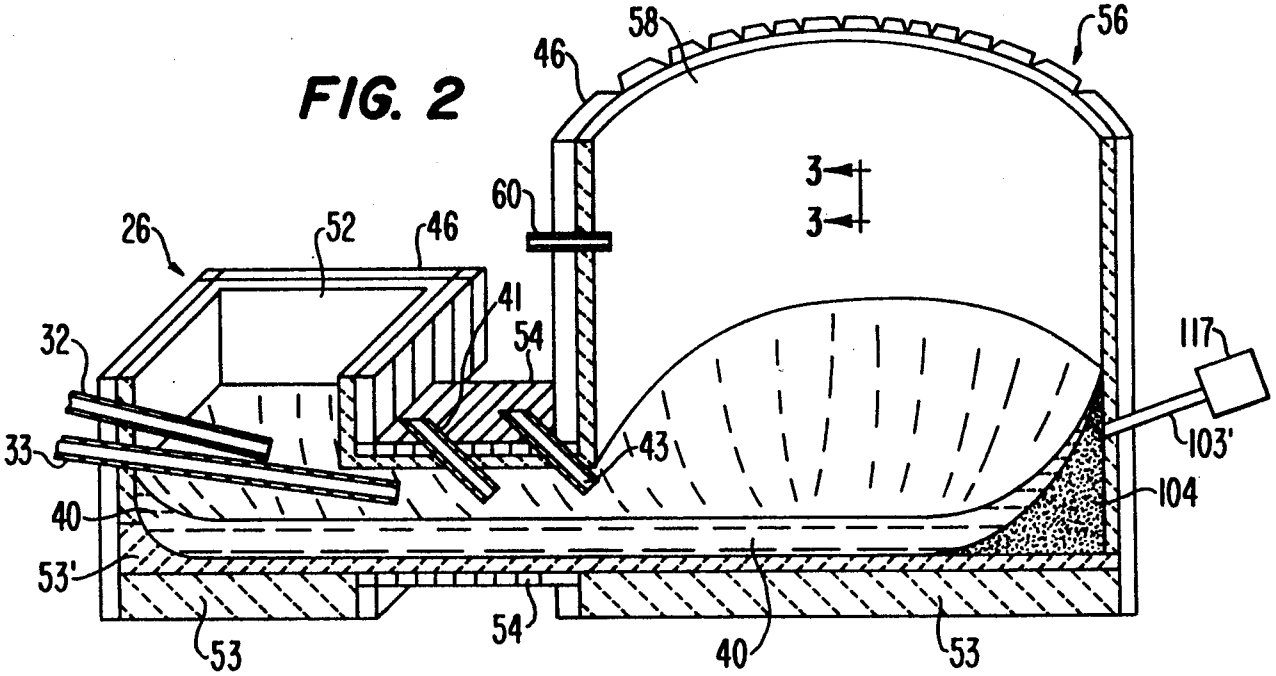
FIG. 2 is a partial cross-section of a portion of the oxidizing means of the embodiment of FIG. 1.

As shown schematically in FIG. 2, a portion of the noncombustible fines are melted and collect at the bottom of first oxidizer 26 in the form of liquid slag 40. The apparatus may optionally include burners directed into first oxidizer 26 for the purpose of raising the temperature at various locations within the oxidizer 26. As here embodied and depicted in FIG. 2, the first oxidizer 26 includes fuel-oxygen lances 32 and 33. Similarly, fuel-oxygen lances 41 and 43 are directed to the surface of the slag 40; and the flame slightly impedes flow of slag from a second oxidizer 56 to first oxidizer 26. Fuel-oxygen lance 32 is directed to the slag 40 in the central portion of first oxidizer 26.

As depicted schematically in FIGS. 1 and 2, the first oxidizer 26 is a water-cooled, metal-walled, refractory-lined vessel in flow communication with the entry portion 12 of the rotary kiln 10. The first oxidizer 26 in the present embodiment has a square cross section and includes vertical metal walls comprised of vertically oriented tubular metal coolant conduits 46. Preferably the conduits 46 are generally rectangular in cross section. In this embodiment, 4 by 8 inch rectangular A500B steel tubing, having a 0.5 inch wall thickness, was used as the conduit.

A coolant supply system (not shown) supplies coolant to the conduits 46 of the first oxidizer 26. The coolant flows through a conventional header system into the conduits 46 at the lower portion of the oxidizer and flows upward through the conduits. The temperature and flow rate of the coolant affect the temperature of the walls of first oxidizer 26; and may be used as process variables to control oxidation within the apparatus. There are, however, constraints on the coolant flow because it affects the temperature of the oxidizer walls. If coolant flow and other process variables are such that the wall temperature is too low, then material within the oxidizer may deposit on the inner walls of the oxidizer. In the preferred embodiment the presence of the refractory lining, however, prevents corrosion of the metal oxidizer walls. If the coolant flow and other process variables are such that the interior of the oxidizer walls operate at too high a temperature, the refractory lining prevents the metal walls from being oxidized or overheated with a resulting loss in wall strength. The presence of metal pins within the refractory lining promote thermal conductivity across the refractory lining reducing thermal gradients and extending the useful life of the refractory lining. In the oxidizer 26, the refractory lining with the pins passing therethrough covers the entire interior surface of the vessel. The refractory lining is preferably 90% Alumina refractory from 2 to 3 inches (5 to 7.5 centimeters) thick with 0.375 inch (10.2 millimeter) threaded stainless steel pins on centers of about 1 inch (2.5 centimeters) where flame impinges on the refractory lining and about 2.5 to 3 inches (5.8 to 7.5 centimeters) where there is no direct flame impingement on the refractory lining. This provides from about 390 to 1550 pins per square meter.

Where water is used as the coolant, the coolant temperature should be kept in the range of from 100° F. to 175° F. Preferably, the coolant flow through the first oxidizer 26 keeps the interior wall surface at a temperature of less than about 600° F. and preferably about 300° F.

The first oxidizer 26 may further include refractory brick 53 at the bottom due to the operating temperatures at that portion of the oxidizer caused by the flowing liquid slag 40 transmitting heat from the hot gases passing through the interior portion 52 of the oxidizer 26. Alternatively or additionally, the slag may be allowed to accumulate and solidify to form a solid shell 53' supporting the molten slag much like the solid "skull" in skull melting operations.

In the embodiment of FIG. 2, the hot gases are turned 90 degrees toward a conduit 54 connecting the first oxidizer 26 with a second oxidizer 56. The construction of the second oxidizer 56 is similar in some respects to that of the first oxidizer 26. In the embodiment shown, however, the second oxidizer 56 is cylindrical with an interior 58 that is also cylindrical.

The hot gases and particulate noncombustible fines pass from the first oxidizer 26 through the conduit 54 to the second oxidizer 56. The construction of the conduit 54 and the second oxidizer 56 is similar to that of the depicted embodiment of the first oxidizer in that they are water-cooled, metal-walled, refractory lined vessels.

Similar to first oxidizer 26, the second oxidizer 56 may also include refractory at the bottom portion thereof; or the slag may be allowed to solidify to form a solid layer 53' as was previously disclosed with respect to oxidizer 26. The function of this layer has been discussed above. Similarly, the walls of the second oxidizer 56 are cooled by flow of coolant from a source (not shown) into the lower portion of the oxidizer 56. Oxidizer 56 receives preheated coolant that has been used to cool a cross-over 72. The coolant flows upward within the conduits 46 and the walls of the second oxidizer are preferably kept in the range of from 300° F. to 600° F.

In the embodiment depicted, not all of the combustion of waste materials occurs in first oxidizer 26. A significant portion also occurs in second oxidizer 56. Thus, in the operation of the embodiment of FIG. 1, noncombustible waste fines pass from an interior portion 52 of first oxidizer 26 through the conduit 54 into an interior portion 58 of the second oxidizer 56. In the preferred embodiment, the conduit 54 is generally reotangular; and is comprised of water cooled upper walls and a refractory or slag lined lower portion. The upper walls are cooled in this embodiment by coolant that is the coolant output from the first oxidizer 26. The upper walls of the conduit 54 are preferably kept in the range of from 300° F. to 600° F. for the reasons set out above with respect to the first and second oxidizers.

In a preferred embodiment, liquids are injected into second oxidizer 56, as here embodied, through a liquid inlet 60. The source of liquid for liquid inlet 60 in the present embodiment comprises a sump system (not shown) surrounding the entire apparatus. Any liquid, such as rain water or contaminated rain water is collected in such a sump system and injected into the second oxidizer 56 through liquid inlet 60. In addition, waste derived fuels may be injected through liquid inlet 60.

There is also provided a means for cooling the noncombustible fines and waste gas. As here embodied and depicted schematically in FIG. 1, there is included a third oxidizer 62. The third oxidizer may be water cooled by passing coolant through the plurality of conduits that make up the walls of the vessel.

Third oxidizer 62 includes a water inlet 64 for introducing water to the interior of the vessel. In flow communication with the water inlet is a source of water 66.

In the present embodiment the water source 66 is fed water that does not include waste. It is the function of the water from the water source 66 to cool the waste gas and noncombustible fines down to a temperature between about 350° F. to 400° F., such that the gas and particulate material can be separated by conventional separation means to be hereinafter disclosed. Optionally, the cooling means can be placed in another vessel (here vessel 65) downstream from oxidizer 62. In such an embodiment the material coming into oxidizer 62 is at a temperature of about 1600° F. and leaves at a temperature of about 1400° F. In this embodiment the input to the filtering means, here manifold 71 and filters 74, is at a temperature of about 400° F. or less.

The preferred embodiment further includes means for passing the gaseous combustion by-products from the kiln and the waste gas through the oxidizer means. As here embodied, there is included cross-over 72 in flow communication between the second oxidizer 56 and the third oxidizer 62. In the preferred embodiment where the second and third oxidizers are vertically oriented cylindrical vessels, the cross-over 72 is a U-shaped vessel connecting the top openings of the second and third oxidizers. In such a configuration, the air flow past the spray nozzles (not shown) is generally parallel to the spray from the nozzles; and the particulates are efficiently cooled with a minimum of agglomeration.

Figure 3:
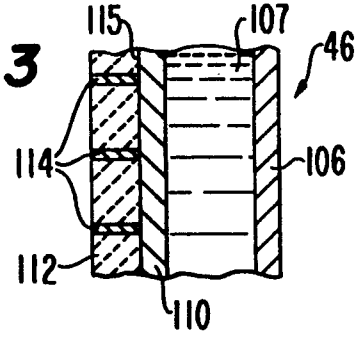
FIG. 3 is a cross-section of the water-cooled vessel wall depicted in FIG. 2.
Figure 4:
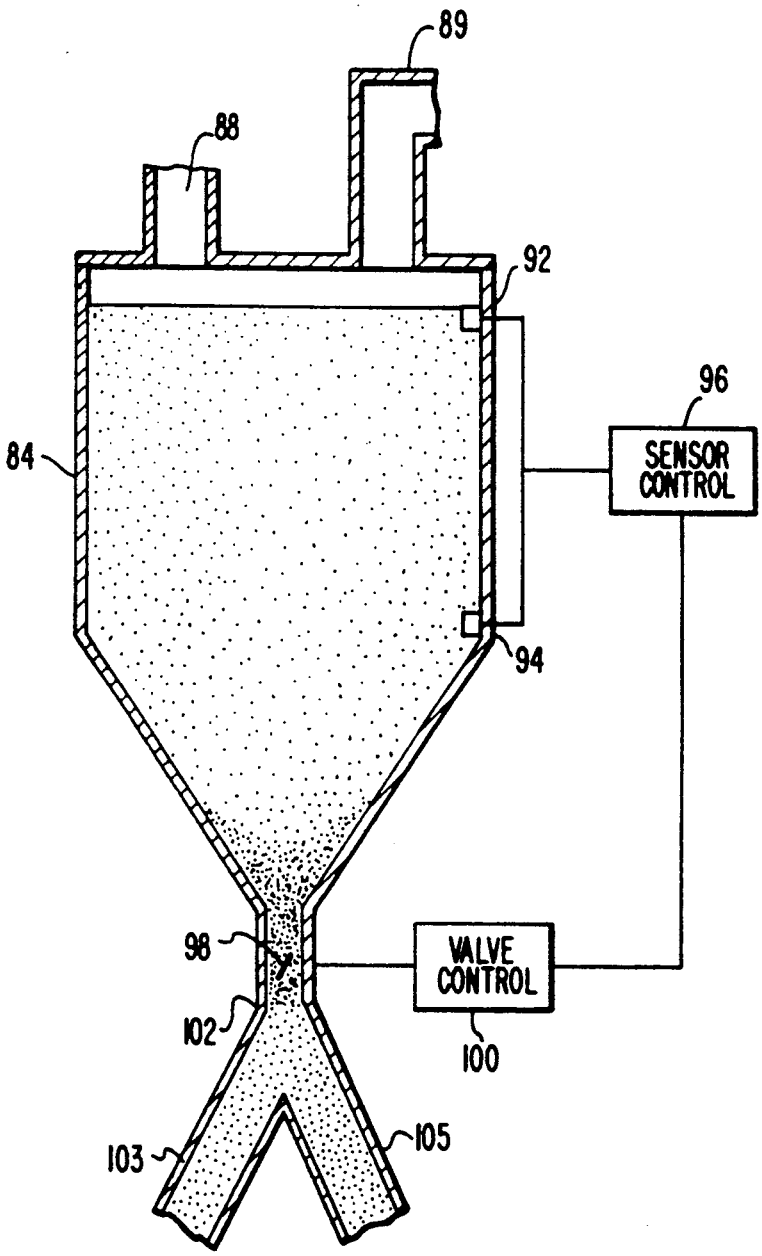
FIG. 4 is a schematic representation of an embodiment for accumulating particulate material that is introduced into the oxidizing means of the embodiments of FIGS. 1 and 2.

The cross-over 72 is a metal-walled, water-cooled vessel constructed of tubes and spacers as depicted in FIG. 4 of U.S. Pat. No. 4,986,197. In the present embodiment, however, the cross-over 72 also includes a refractory lining as is depicted in FIG. 3 herein. The crossover 72 receives cooling water preheated by the passage through oxidizer 26 and conduit 54, which as previously mentioned, flows to second oxidizer 56.

Operation of the preferred embodiment has determined that water cooling of the third oxidizer 62 is not necessary. The embodiment depicted includes an optional fourth oxidizer 65. This increases the residence time of the material within the oxidizer means and further assists in the elimination of acids within the waste gases.

In this embodiment, oxidizers 62 and 65 are connected at their lower extremities by a connector 73. Preferably, the apparatus includes means for removing solid particulate material from the bottom of the oxidizers. As here embodied and depicted schematically in FIG. 1, there is provided a drag conveyor 75 for extracting solid particulate material that would otherwise accumulate at the bottom of oxidizers 62 and 65 as well as within the connector 73 between these two oxidizers. The solid particulate material so collected is introduced to a conduit 77 leading to the accumulator 84 for reintroducing to second oxidizer 56.

As here embodied and depicted in FIG. 1 schematically, there is a source of caustic material 67 which is in flow communication with the fourth oxidizer 65. It is the function of the caustic material to neutralize acid within the waste gas. The caustic material may be injected as a liquid or as a dry particulate, such as hydrated lime, through a pH control inlet 70. Optionally, caustic material can be introduced into the third oxidize 62.

In making connections between the various elements of the present invention, the effect of differential thermal expansion must be considered because of the high temperatures of the materials within first and second oxidizers 26 and 56, conduit 54 and cross-over 72. In addition, significant temperature differentials in different portions of the apparatus exist so that accommodation at the interface between such portions must be made for expansion and contraction.

The system is preferably run at less than an atmospheric pressure. Thus, any leakage at the interface between portions of the apparatus is not detrimental to the performance of the apparatus so long as the amount of leakage is not so excessive to detrimentally effect the combustion of materials within the oxidizers. This requirement is not as critical portions of the device other than the oxidizers operating at lower temperatures.

The preferred embodiment includes means for separating the noncombustible fines and the waste gas. As here embodied and depicted schematically in FIG. 1, the apparatus includes three filters 74 operating in parallel driven by two fans 76. The waste gas and particulate fines are introduced to the filters at a temperature preferably more than 350° F. and less than 400° F. so that conventional baghouse filters may be used. Operation of the present embodiment has determined that conventional teflon filter elements can be used in connection with this operation. The waste gas is separated from the noncombustible particulate fines, and the waste gas is then passed by monitoring means 78 that monitors the composition and temperature of the waste gas. The waste gas is then passed into the atmosphere through a stack 80. The particulate fines accumulated in the filters 74 are conveyed by means of a pump means 82 through conduit 77 to an accumulator 84. Similarly, particulate material from the kiln may be passed through conduit 85 by means of pump 86 into the accumulator 84.

In accordance with the invention, there is provided means for introducing noncombustible particulate material to the apparatus to form a substantially molten mixture. As here embodied and depicted in FIGS. 1 and 2, the apparatus includes means for introducing the noncombustible particulate materials to second oxidizer 56. As depicted in FIGS. 1 and 4, accumulator 84 includes an inlet 88 disposed to receive particulate material from conduits 77 and 85. This embodiment includes a vent 89 leading to a filter (not shown).

Associated with the preferred embodiment and shown in FIG. 4, the accumulator 84 has an outlet valve 98 controlled by means of valve control means 100. During operation of the apparatus, the inlet 88 introduces particulate material into the accumulator 84 where it accumulates. The particulate material can be added the to the apparatus in a number of ways Preferably, a control means 100 opens the valve 98, thereby allowing particulate material to pass through a conduit 102 into conduits 103 and 105, which both introduce the particulate material into the second oxidizer 56 as depicted in FIG. 2.

In this embodiment solid particulate material is introduced into the second oxidizer 56, however, solid particulate material may also be introduced into first oxidizer 26 or both the first and second oxidizers.

As shown in FIG. 2, the solid particulate material is introduced to the second oxidizer through a particulate batch injector 117 into and beneath the surface of pile 104. The particulate batch injector 117 preferably forces a batch of particulate material through conduit 103 into vessel 56. A similar particulate batch injector (not shown) may be associated with the conduit 105 or conduit 105 can introduce particulate material to the surface of the pile 104 in the manner disclosed in the previously cited patents to John M. Kent. Preferably, both conduits, 103 and 105, inject particulate material beneath the surface of the pile 104.

Figure 7:
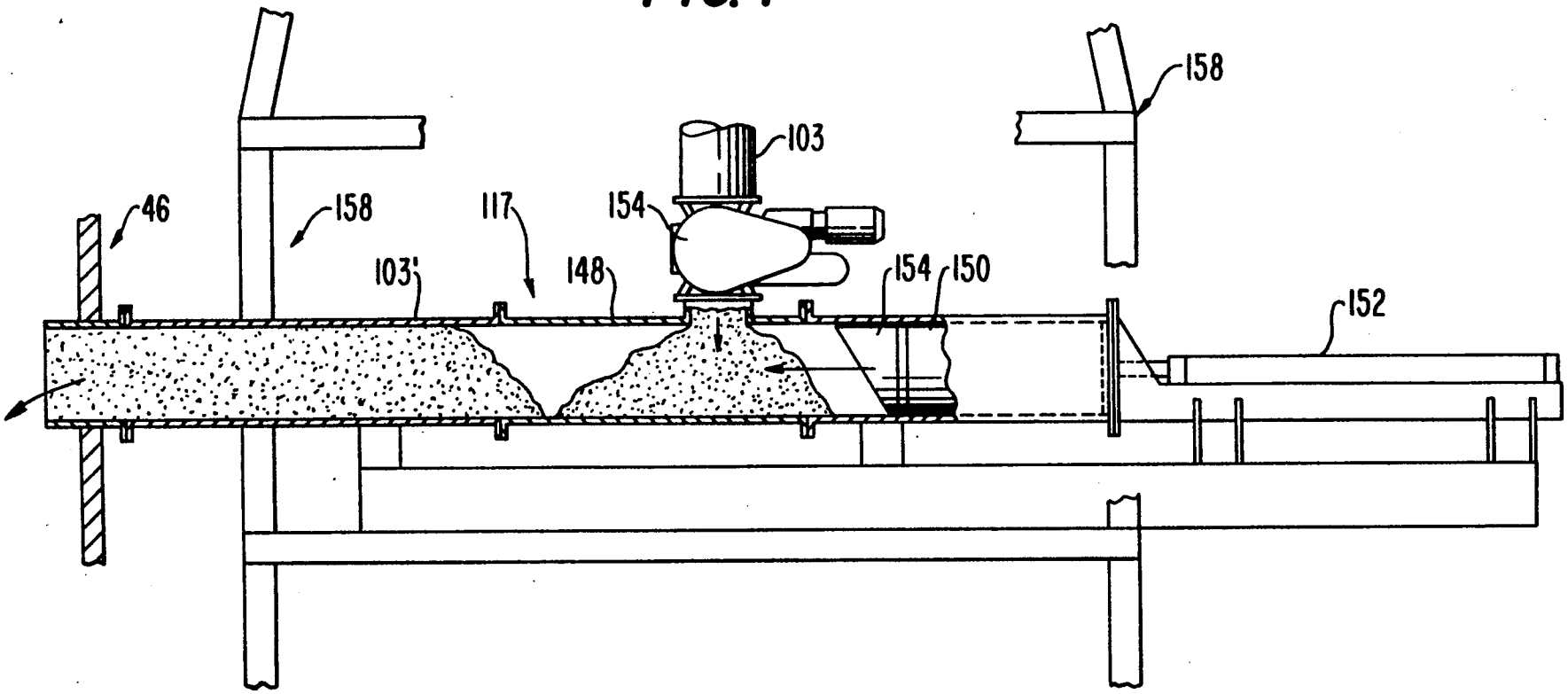
FIG. 7 is a schematic cross-section of a second means of injecting particulate material into the oxidizing means of the present invention.

As depicted in FIG. 7, there is a particulate batch injector 117 comprised of an injection cylinder 148 containing a feedram 150 mechanically linked to a hydraulic cylinder 152. The feedram includes a hollow, beveled end cap 154. The ram is capable of reciprocating along its longitudinal axis to move the feedram 150 to the position depicted in FIG. 8.

Figure 8:
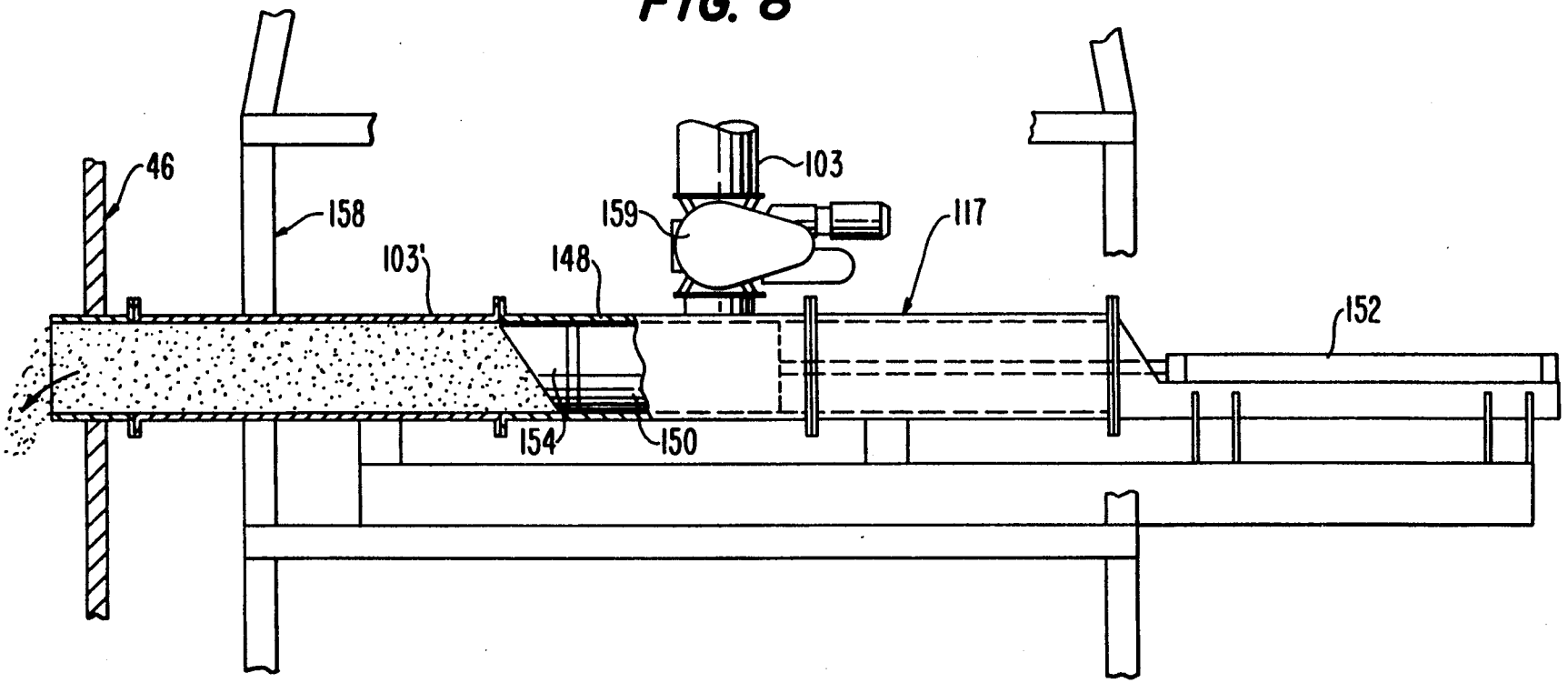
FIG. 8 is the embodiment of FIG. 7 with the feedram in a second, alternate position.

Also associated with the injection mechanism of FIGS. 7 and 8 is a feed mechanism 154 disposed to control the introduction of particulate material to the interior bore of the cylinder 103'. The feed mechanism is connected to the accumulator 84 by the conduit 103. During operation of this embodiment, particulate material from the accumulator 84 is fed into the bore of the injection cylinder 148 until there is a sufficient amount of material therein. The hydraulic cylinder 152 is then activated and the ram moves from the position depicted in FIG. 7 to the position depicted in FIG. 8, thereby forcing particulate material through the conduit 103' toward the interior of the oxidizing means where the particulate material is received. As shown in FIGS. 7 and 8, the feedram 150 is spacially separated from the walls of the oxidizer and a portion of the conduit 103' remains full of particulate material with additional particulate material moving under influence of the feedram 150 forcing that material through the conduit. The entire apparatus is suspended and affixed to the exterior portion of the apparatus on the framework 158.

FIG. 8 depicts another preferred embodiment 117' for injecting particulate material into the apparatus. As here embodied, there is a spiral screw auger 160 in flow communication with the conduit 103 to a source of particulate material. The screw auger receiving particulate material through the conduit turns in response to a motor (not shown) forcing particulate material through the conduit 103'' and into the apparatus. As a practical matter, the conduit 103'' between the auger 160 and the apparatus must be tapered and have a diameter no less than about 9 inches (23 centimeters). For such a tube the taper should be no less than three-quarters of an inch for every foot of length of the tube 103''. Komar Industries, Inc. of Groveport, Ohio, U.S.A. is a source for such an apparatus.

Heat from the gas passing through the second oxidizer 56 is impinged on the surface of the pile of particulate material melting the portion of the particulate material that has a melting point below that of the gas being impinged on the surface. The layer of molten material above the injected particulate material forms a seal that prevents volatile heavy metals or other relatively volatile materials within the injected material from being entrained in the gas stream passing through the apparatus toward the stack 80. Thus, undesirable volatile materials such as heavy metals are entrained in the molten material 40 that is later solidified into non-hazardous solids rather than passing downstream with the gases and potentially being passed from the system within the stack gas.

Figure 5:
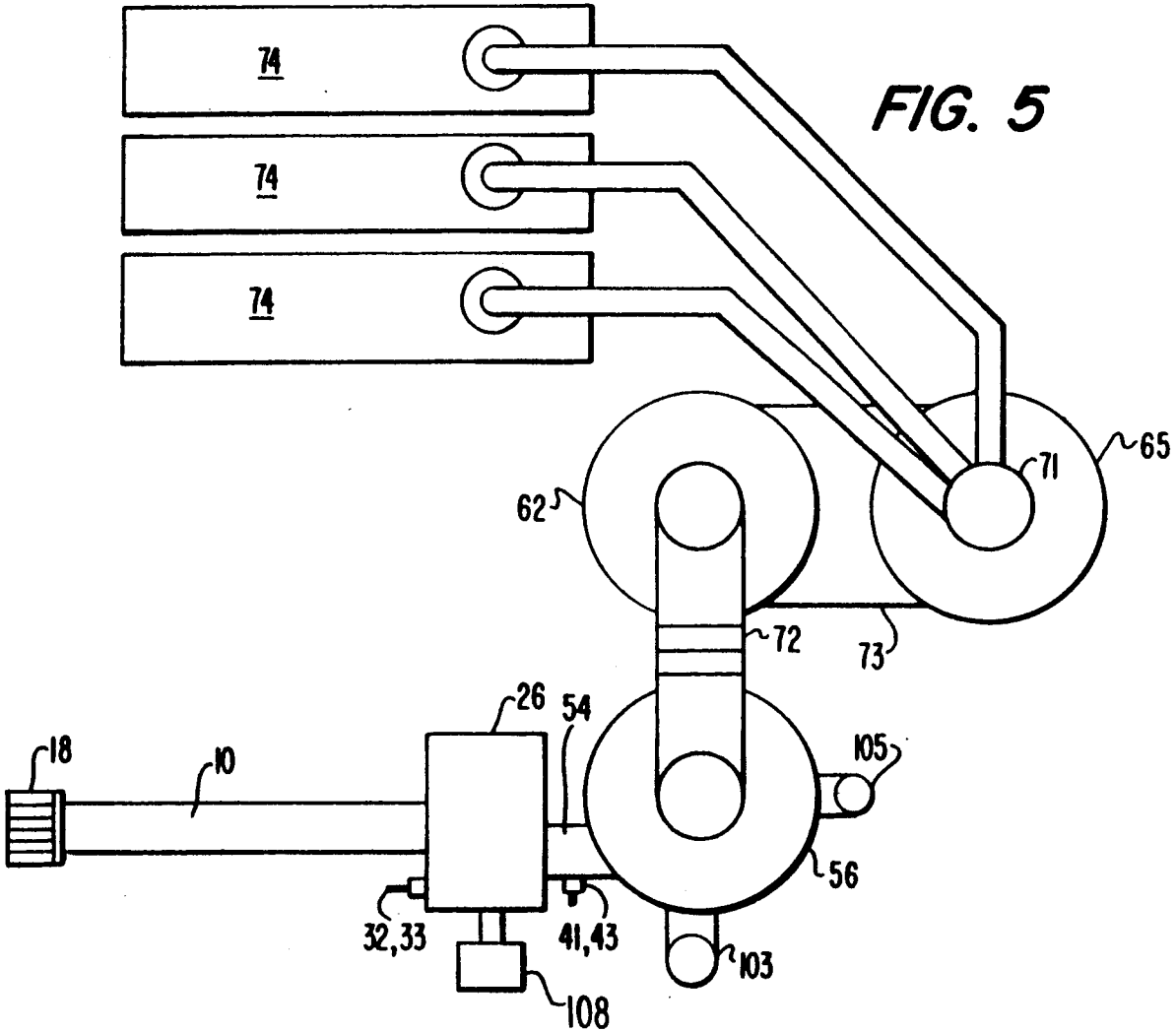
FIG. 5 is a schematic top plan view of a system including an embodiment of the present invention.
Figure 6:
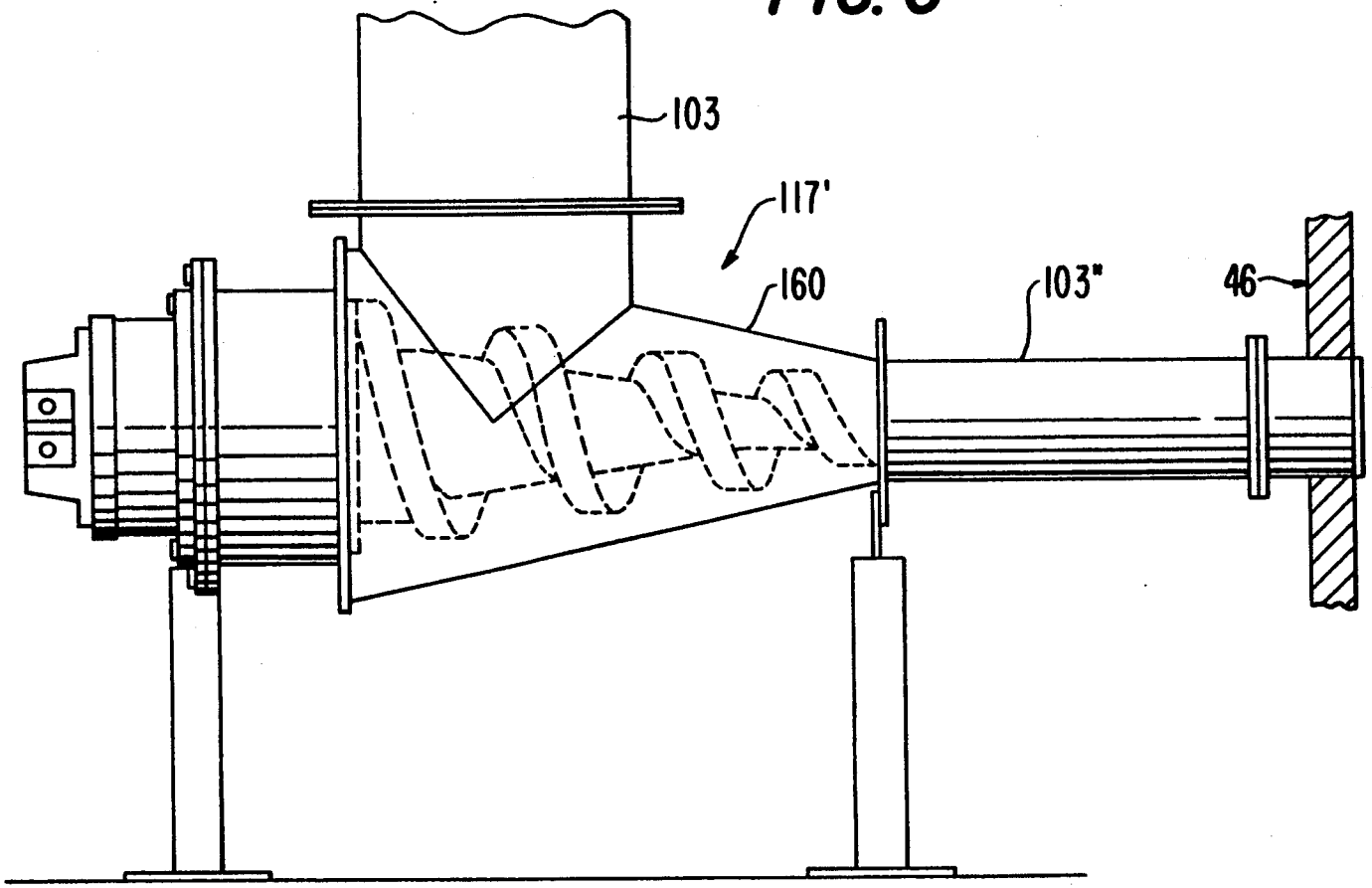
FIG. 6 is a schematic cross-section of one means of injecting particulate noncombustible materials into the oxidizing means of the present invention.

The molten material flows from the pile 104 entraining any particulate material that is not melted therein and joins the molten slag 40 at the bottom of oxidizer 56. As depicted in FIG. 2, the liquid slag 40 accumulates on the bottom of oxidizer 26, the conduit 54 and the oxidizer 56. While the molten slag may be extracted from the conduit 54, it is preferred to remove the molten slag 40 from the apparatus by means of a separate slag box, shown schematically in FIGS. 1 and 5 as slag box 108. The construction of such a slag box is disclosed in U.S. Pat. No. 4,986,197, however, the interior surface of the slag box is covered with a refractory lining 112 as depicted in FIG. 3 herein.

In accordance with the invention, the apparatus includes means for cooling the substantially molten mixture to form the non-hazardous aggregate. As here embodied, the device includes cooling means 106 depicted schematically in FIG. 1. In the preferred embodiment, the cooling means simply comprise water into which the substantially molten mixture is dumped. The cooling means extracts the heat from the molten mixture and forms the non-hazardous aggregate.

Operation of the previously described apparatus will now be described in terms of a process for using hazardous waste in a manufacturing process to form a non-hazardous aggregate. The preferred operating parameters of the process are set out in U.S. Pat. No. 4,986,197 to John M. Kent.

The process includes the step of inducing combustion in an oxidizing means to convert waste fine to noncombustible fines, molten slag and waste gas. As here embodied, the oxidizing mean is comprised of three oxidizers, the first oxidizer 26, second oxidizer 56 and third oxidizer 62. In the first oxidizer 26, a major portion of the combustible material is oxidized to form gaseous combustion by-products. These are drawn through interior 52 of first oxidizer 26 through the conduit 54 and into interior 58 of second oxidizer 56. At the temperature of operation, 1800° to 3000° being preferred, some of the solid material is melted. This material collects at the bottom portion of the first oxidizer, as shown in FIG. 2, as the liquid slag 40, which then runs toward the slag box 108 of FIGS. 1 and 5. The unmelted solid particulate material passes, with the gaseous combustion by-products, through the conduit 54 into the interior of second oxidizer 56 where a portion may be melted in the second oxidizer, or it may remain unmelted and pass through the device as solid particulate fines.

Solid particulate material is introduced into the oxidizing means. As here embodied and clearly depicted in FIG. 2, conduit 103' introduces the solid particulate materials to the interior of the second oxidizer 56. Preferably, the solid particulate material is introduced in discrete batch portions. Continuous introduction of these materials into the oxidizer cools the pile of particulate material within the oxidizer preventing melting of the surface. This inhibits the melting of the particulate material being introduced to the oxidizer; and thereby inhibits the production of the molten slag that forms the non-hazardous aggregate.

As depicted schematically in FIG. 2, it is preferred that the discrete batch portions of particulate material be introduced to the second oxidizer to form a pile in the oxidizer. Heat from the oxidizing means is impinged on the surface of the pile whereupon material having relatively low melting points is melted to run down to the bottom of the oxidizer toward the conduit 54 where the molten material flows to the first oxidizer 26 and exits the slag box 108. The process may generate particulate materials that have melting points higher than the temperature of the second oxidizer and such particulate material would not be melted. Such material is, however, entrained within the molten material formed in the second oxidizer and into the slag to form a substantially molten mixture. By melting the surface of the pile and allowing the molten material and the solid particulate material entrained therein to run toward the conduit 54, a new surface is exposed on the particulate material that is then melted to run out of the apparatus through the slag box. While the embodiment shown herein illustrates the introduction of the particulate materials to the second oxidizer, the process is also operable if a portion of that material is introduced to the first oxidizer.

The process embodiment of the invention is an improvement to the step of adding particulate material to the accumulation of material in the oxidizing means. In the present invention and the above cited patents, U.S. Pat. Nos. 4,922,841 and 4,986,197 to John M. Kent noncombustible material is added to the oxidizing means to form a pile or accumulation in the oxidizer. This is done by injecting batches of such material from an external source of particulate material into the oxidizer where the heat of the gaseous combustion by-products melts much of the injected material.

The improvement of the present invention is to inject the batches of particulate material beneath the molten surface of the accumulation of material. As noted above this prevents volatile materials in the newly introduced batch, such as heavy metals, from being driven off into the gas stream; and instead, these materials are entrained into the molten material to become part of the solid, non-hazardous, non-leaching aggregate.

The process includes a step of cooling the mixture of molten slag and solid particulates to form a non-hazardous aggregate. In the preferred embodiment, the mixture of molten slag and solid particulates is introduced to a water filled conveyer where the quenching effect of the water cools the mixture to form the solid non-hazardous, non-leaching aggregate. The water used to cool the molten material is then reintroduced to the process either with waste water into the second oxidizer 56 or into the third oxidizer 62.

Operation of the present invention results in the production of four effluents: ferrous metal, which is passed through the rotary kiln and is thus free of hazardous material; clinker that is passed through the rotary kiln, which if it contains hazardous material is either bound into the structure of the clinker or is reintroduced to the process until the clinker composition is non-hazardous. The third effluent is the gaseous effluent from the stack 80 and consists primarily of carbon dioxide and water. The fourth effluent is the solid non-hazardous, non-leaching aggregate.

The preferred embodiment is now classified as an industrial furnace under EPA's boiler and industrial furnace regulations issued under the authority of the resource conservation and recovery act (RCRA) and is subject to air emission and process control requirements which are considered by EPA to be at least as stringent as the same considerations applied to a Part "B" hazardous waste incinerator. The present invention readily meets such a criteria. In addition to meeting stringent air quality specifications, the aggregate produced from the process while containing heavy metals that would be hazardous if removable from the aggregate, has converted the material to a form where the heavy metals are bound into the glass-like aggregate. Specifically, the levels of arsenic, barium, cadmium, chromium, lead, mercury, selenium and silver are all well below the regulatory limit. In addition, the concentration of pesticide herbicide compounds, acid phenol compounds, base neutral compounds and other volatile compounds are well below the regulatory limits. Thus, although the input materials may contain hazardous materials, the materials are either oxidized by oxidation or locked within the structure of the aggregate such that the process produces no hazardous effluents.

The present invention has been disclosed in terms of preferred embodiments. The invention, however, is not limited thereto. The scope of the invention is to be determined solely by the appended claims and their equivalents.

What is claimed is:

1. An apparatus for converting hazardous waste into non-hazardous, non-leaching aggregate, said apparatus comprising:

a source of particulate solid materials, volatile gases and gaseous combustion by-products;

oxidizing means comprising at least one refractory-lined, water-cooled, metal-walled vessel;

means for introducing said particulate solid material, volatile gases and gaseous combustion by-products to said oxidizing means;

means for inducing combustion in said oxidizing means, the heat of combustion forming molten slag and noncombustible fines from noncombustible material;

means for accumulating said slag;

means for introducing said noncombustible fines to said molten slag to form a substantially molten mixture, said introducing means including means for injecting portions of said noncombustible fines to said molten slag beneath the outer surface of said slag;

means for removing said mixture from said apparatus; and means for cooling said mixture to form said non-hazardous, non-leaching aggregate.

2. The apparatus of claim 1 including means for introducing said noncombustible fines to said slag in discrete portions.

3. The apparatus of claim 1 wherein said introducing means places said noncombustible fines in said slag in the form of a pile.

4. The apparatus of claim 3 wherein said pile has a sloped outer surface with heat from said oxidizing means being impinged on said surface.

5. The apparatus of claim 4 wherein said sloped outer surface is molten.

6. The apparatus of claim 5 wherein said injecting means injects noncombustible fines into said pile beneath the molten surface of said pile.

7. The apparatus of claim 1 wherein said slag is accumulated in said oxidizing means.

8. The apparatus of claim 1 wherein said oxidizing means comprise a plurality of vessels.

9. The apparatus of claim 8 wherein said oxidizing means comprise at least three oxidizers.

10. The apparatus of claim 1 wherein said source of particulate solid materials, volatile gases and gaseous combustion by-products comprises a rotary kiln.

11. A process for converting hazardous waste into non-hazardous, non-leaching aggregate where particulate solid materials are oxidized to form noncombustible fines, the process comprising the steps of:

melting a portion of said noncombustible fines to form a layer of molten material;

adding another portion of said noncombustible fines to said molten material beneath said layer to form an accumulation of noncombustible material;

melting the surface of said accumulation to form a molten mixture; and cooling said mixture to form said non-hazardous, non-leaching aggregate.

12. The process of claim 11 including the step of adding said noncombustible fines to said layer in discrete portions.

13. The process of claim 11 including the step of forming a pile from said portions of noncombustible fines.

14. The process of claim 13 including the step of impinging heat on the surface of said pile.

15. The process of claim 14 wherein said pile has a sloped outer surface including the step of impinging heat on said surface.

16. The process of claim 15 including the step of melting said sloped outer surface such that molten material on said surface runs from said surface exposing a new surface on said pile.

17. An apparatus for converting hazardous waste into non-hazardous, non-leaching aggregate, said apparatus comprising:

a source of high temperature gases, vapors, particulate materials or mixtures thereof;

at least one hollow vessel having an interior in flow communication with said source, said vessel having a wall construction comprising; a water-cooled metal wall and a refractory inner lining, wherein said vessel includes a plurality of metal members passing through said refractory inner lining and contacting said metal wall, said metal members being effective to reduce the operating temperature of said refractory inner lining;

means for introducing said high temperature gases, vapors, particulate materials or mixtures thereof to said vessel;

means for inducing combustion in said vessel to convert said high temperature gases, vapors, particulate materials or mixtures thereof into noncombustible fines, molten slag, and waste gas;

means for introducing a portion of said noncombustible fines, to said molten slag to form a substantially molten mixture, said introducing means placing portions of said noncombustible fines beneath the outer surface of said slag;

means for removing said mixture from said apparatus; and means for cooling said substantially molten mixture to form said non-hazardous, non-leaching aggregate.

18. The apparatus of claim 17 wherein said refractory inner lining is substantially monolithic.

19. The apparatus of claim 17 wherein said refractory inner lining is comprised of a layer consisting essentially of alumina.

20. The apparatus of claim 17 wherein said refractory inner lining includes a plurality of metal pins contacting said metal wall, a substantial number of said pins passing through said refractory lining.

21. The apparatus of claim 19 wherein said refractory inner lining includes a plurality of relatively straight pins at substantially right angles to the interior of said vessel.

22. The apparatus of claim 20 wherein said refractory inner lining includes from about 390 to 1550 pins per square meter of refractory lining.

23. The apparatus of claim 22 wherein said pins have a diameter in the range of from about 6.3 to 10.2 millimeters.

* * * * *